US009114854B2

(12) United States Patent
Williams et al.

(10) Patent No.: US 9,114,854 B2
(45) Date of Patent: Aug. 25, 2015

(54) FOLDING WAKEBOARD TOWER WITH COVER

(71) Applicant: Xtreme Marine Corporation, Maryville, TN (US)

(72) Inventors: Anthony Duane Williams, Maryville, TN (US); Bradley Michael Nemeth, Oak Ridge, TN (US); Robert Blaine Metcalf, Lenoir City, TN (US)

(73) Assignee: Xtreme Marine Corporation, Maryville, TN (US)

( * ) Notice: Subject to any disclaimer, the term of this patent is extended or adjusted under 35 U.S.C. 154(b) by 134 days.

(21) Appl. No.: 13/963,603

(22) Filed: Aug. 9, 2013

(65) Prior Publication Data

US 2014/0048007 A1 Feb. 20, 2014

Related U.S. Application Data

(60) Provisional application No. 61/684,179, filed on Aug. 17, 2012.

(51) Int. Cl.

| | |
|---|---|
| ***B63B 17/02*** | (2006.01) |
| ***B63B 21/56*** | (2006.01) |
| ***B63B 35/81*** | (2006.01) |

(52) U.S. Cl.

CPC ..... *B63B 17/02* (2013.01); *B63B 21/56* (2013.01); *B63B 35/816* (2013.01); *B63B 2017/026* (2013.01); *B63B 2221/22* (2013.01)

(58) Field of Classification Search

CPC ..... B63B 17/00; B63B 17/02; B63B 21/56; B63B 35/73; B63B 35/81

USPC ..... 114/253, 361, 364, 343; 224/406

See application file for complete search history.

(56) References Cited

U.S. PATENT DOCUMENTS

| | | | |
|---|---|---|---|
| 6,945,188 | B2 | 9/2005 | Eck |
| 7,013,830 | B1 | 3/2006 | Willis |
| 7,392,758 | B2 | 7/2008 | Metcalf |
| 8,297,484 | B2 | 10/2012 | Jesewitz |
| 2012/0067269 | A1 | 3/2012 | Williams |

*Primary Examiner* — Lars A Olson

(74) *Attorney, Agent, or Firm* — Luedeka Neely Group, P.C.

(57) ABSTRACT

A wakeboard tower having a tower leg pivotally mounted to a folding support system, the folding support system including includes an upper support arm, a spring, a lower support arm, and a base member. The tower can be folded between a plurality of positions between an elevated position relative to the boat hull and a lowered position relative to the boat hull.

14 Claims, 12 Drawing Sheets

FOLDING WAKEBOARD TOWER WITH COVER

CROSS REFERENCE TO RELATED APPLICATION

The present application claims priority to U.S. Provisional Application Ser. No. 61/684,179 , filed on Aug. 17, 2012, and entitled FOLDING WAKEBOARD TOWER WITH COVER, incorporated herein by reference in its entirety.

FIELD

The present disclosure relates to wakeboard towers for boats. More particularly, the disclosure relates to a wakeboard tower of folding construction having a cover.

BACKGROUND

The sport of wakeboarding is very similar to the sports of waterskiing, kneeboarding, and tubing. A wakeboarder or person riding a wakeboard is towed behind the boat by a rope. Typically, waterskiing, kneeboarding, and tubing utilize a motorboat having a rope secured to a stern mount on either or both sides of the motor of the boat. However, in the sport of wakeboarding, a boat having an elevated tower is used and the rope is typically attached to a mount connected to a tower cross member. The mount on the tower provides a much higher connection point for the tow rope and provides vertical component force on the tow rope held by a wakeboarder that allow the wakeboarder to more easily perform aerial stunts and maneuvers. That is, the wakeboarding experience is improved by use of a tow point that is elevated as compared to the lower elevation of tow points used for waterskiing. However, the presence of an elevated tower structure is undesirable when towing and storing of the boat, Accordingly, what is desired is a tower structure that can be folded to an unelevated configuration.

In addition, the provision of a tower having an elevated tow point interferes with the use of conventional bimini covers of the type used on boats having a low tow point. Attempts have been made to incorporate bimini or other sun-shielding covers with wakeboard towers having an elevated tow point. Such covers are not integrated with the tower and are useable at times when the boat is not in use to pull a wakeboarder. However, as the covers can interfere with the elevated tow point of the wakeboard tower, they are generally unsuitable for use when the tow point is in use. This results in undesired sun exposure and other undesirable circumstances resulting from the lack of a cover while the boat is in use to pull a wakeboarder. Accordingly, also desired is a tower structure having a bimini cover that does not interfere with the tow point.

The disclosure advantageously provides a wakeboard tower constructed to include a tow point and a bimini cover that does not interfere with the tow point that, and to such a tower of improved folding construction for improved utility and stability.

In this regard, towers according to the disclosure allow for more compact folding lower to the deck such that the components thereof can be folded to a height that is lower than the top of the windshield of the boat. The enablement of such a foldable tower is very advantageous for trailer and storage of a boat, For example, boat owners often store their boat at a location remote from the water and need to tow the boat to the water. The folded position is advantageous to enable the boat to fit into storage buildings. Also, when the boat is trailered behind a vehicle, the tower may be positioned to be fully folded down for improved aerodynamics. The folded position also reduces the likelihood that the tower and cover will be hit by bugs, road debris, and the like.

The unique configuration is also easy to use, as the components are interconnected to be folded at the same time and in one motion by the user. The configuration also offers improved stability and includes four attachment points attached to provide a great deal of stability at every articulation position, full up, full down, half up, and positions therebetween.

SUMMARY

The disclosure relates to a foldable boat tower mountable to a boat hull.

In one embodiment, the tower includes an arch foldable between an elevated position and a lowered position, and a foldable support system including abuse member mounted to the boat hull. The arch includes a crosspiece and a leg depending from the crosspiece. The foldable support system includes an upper support arm, a lower support arm connected to the upper support arm and the base member, and a spring connected to the leg and the base member.

The tower includes a pivotal connection of the leg to the base member, a pivotal connection of the lower support arm to the base member, a pivotal connection of the upper support arm to the lower support arm, and a pivotal connection of the upper support arm to the leg. The tower can be folded between a plurality of positions between an elevated position relative to the boat hull and a towered position relative to the boat hull.

In another embodiment, the tower includes an arch foldable between an elevated position and a lowered position, the arch having a crosspiece and a pair of legs depending from opposite ends of the crosspiece; and a foldable support system associated with each of the legs.

Each foldable support system includes abase member mounted to the boat hull, an upper support arm, and a lower support arm connected to the upper support arm and the base member, with the leg pivotally connected to the base member, the lower support arm pivotally connected to the base member, the upper support arm pivotally connected to the lower support arm, and the upper support arm pivotally connected to the leg. The tower can be folded between a plurality of positions between an elevated position relative to the boat hull and a lowered position relative to the boat hull.

In an additional embodiment, the tower includes an arch foldable between an elevated position and a lowered position, the arch having a crosspiece and a pair of legs depending from opposite ends of the crosspiece. An elevated tow point is mounted on the arch. A cover including a frame is also pivotally mounted to the arch such that the frame maintains a substantially horizontal orientation when the arch is folded between the elevated position and the lowered position.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
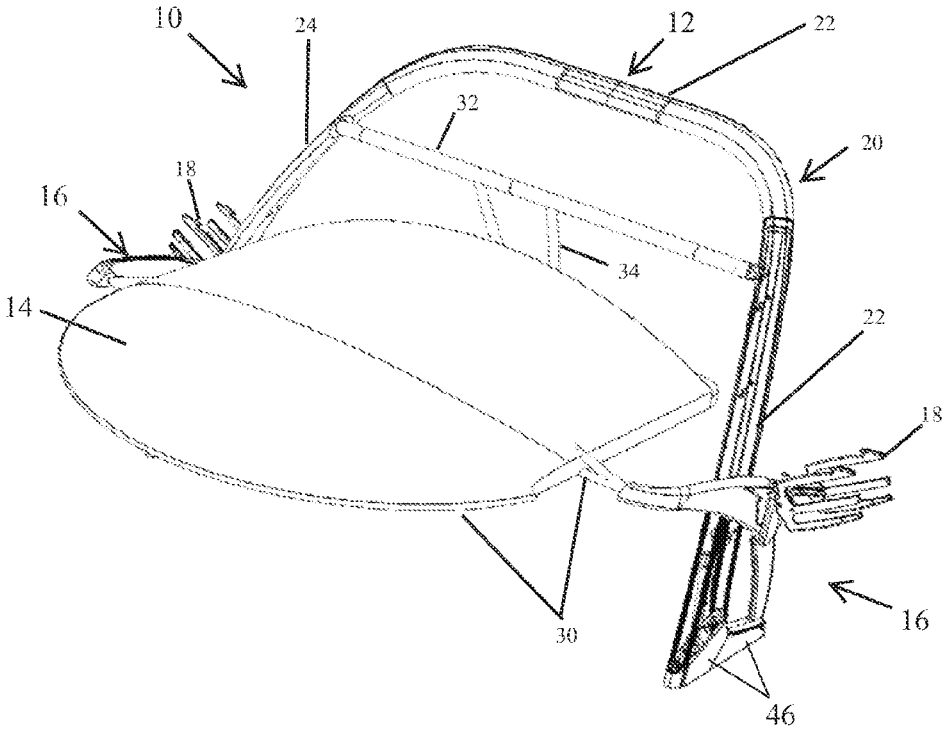
FIGS. 1-4 are perspective views of a foldable wakeboard tower according to the disclosure in a fully elevated position.
Figure 2:
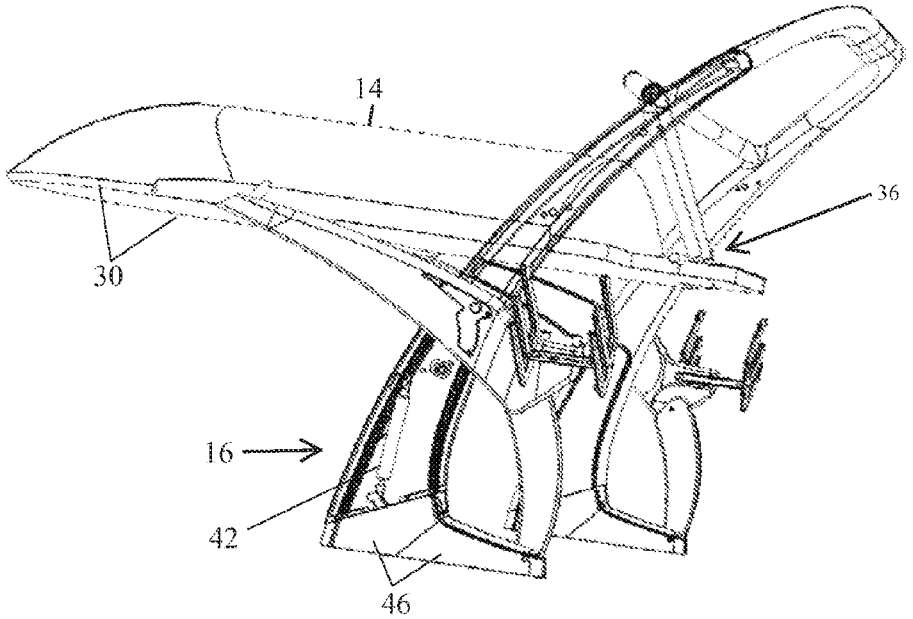
Figure 3:
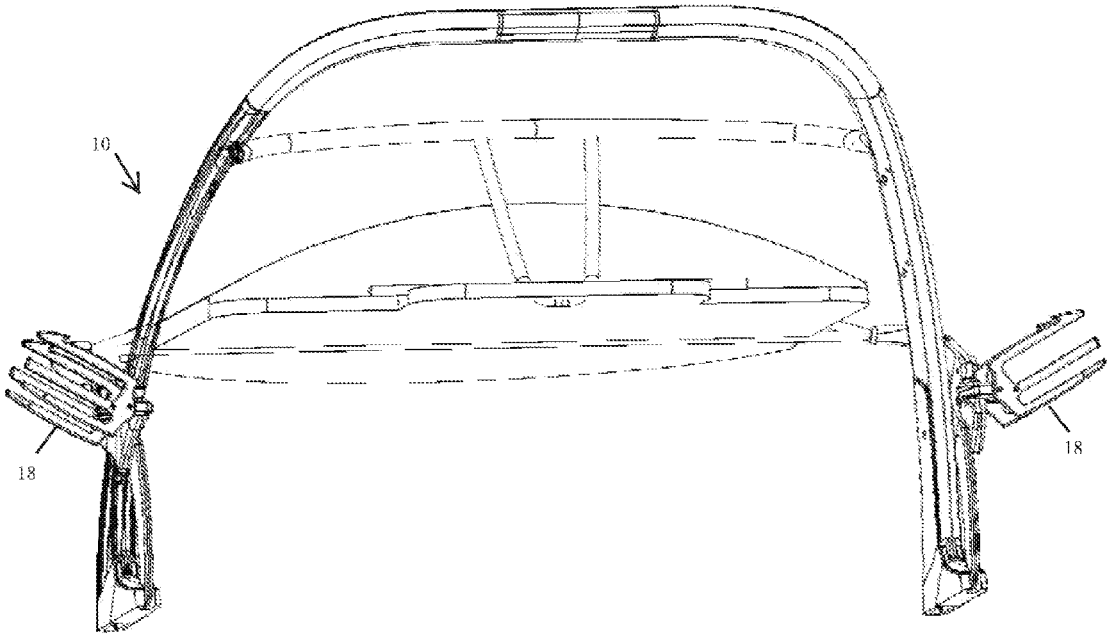
Figure 4:
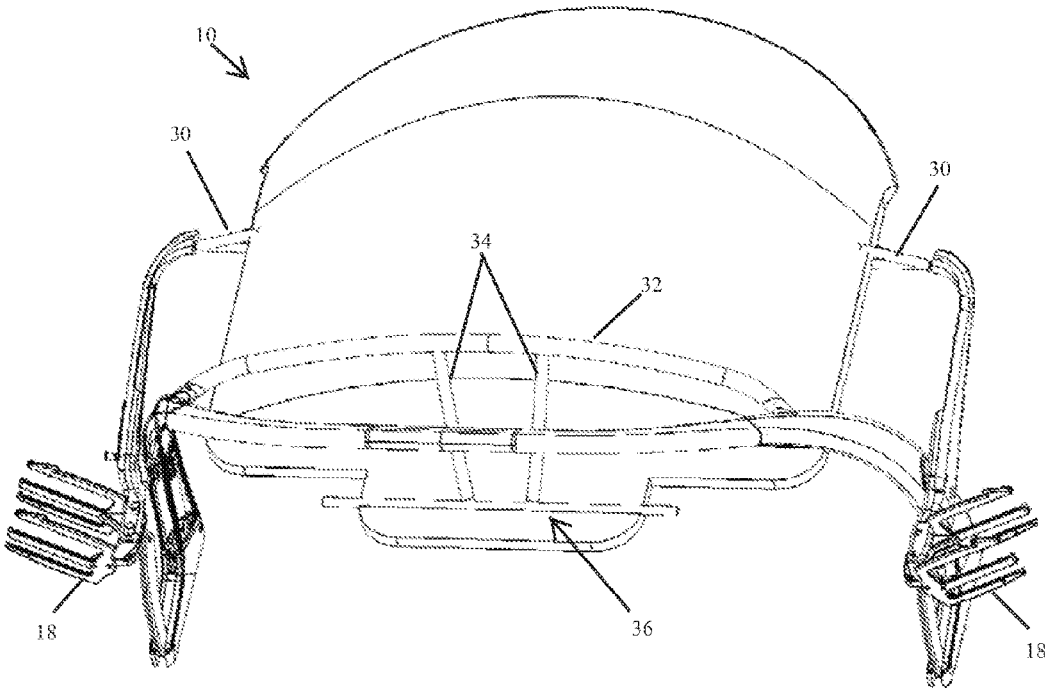

With reference to the drawings, there is shown a wakeboard tower 10 configured according to the disclosure to include an elevated location to provide a tow point, the location thereof being indicated generally by reference numeral 12, and a bimini or other sun cover 14 integrated to the tower 10 in a manner that does not interfere with the tow point location 12. The tower 10 also includes a pair of foldable support systems 16 that enable the tower 10 to be folded to reduce the height of the tower 10. Accordingly, the present disclosure advantageously provides a wakeboard tower that includes a cover and that can be folded between a plurality of fixed positions, such as filly elevated, half elevated, and fully lowered.

It will be appreciated that various conventional wakeboard tower accessories, such as speakers, racks, minors, and lights may be attached onto the tower 10, and the cover 14. In this regard, the tower 10 is shown including a pair of wakeboard racks 18.

Figure 5:
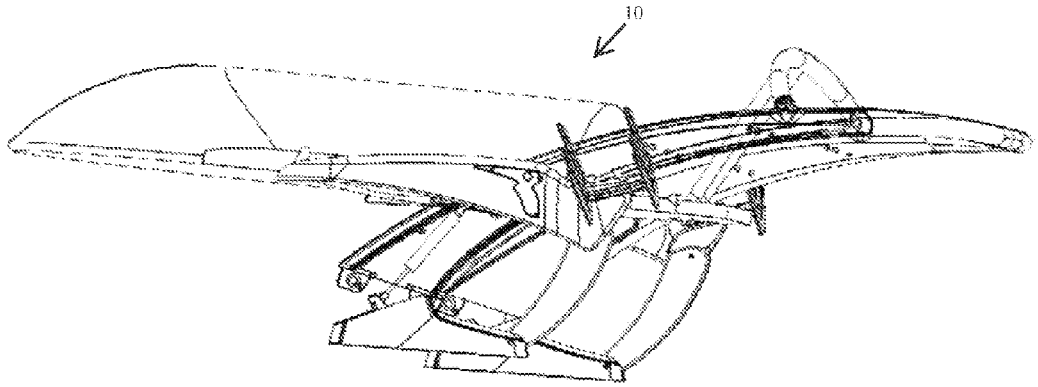
FIG. 5 shows the tower of FIGS. 1-4 in a half-elevated position.
Figure 6:
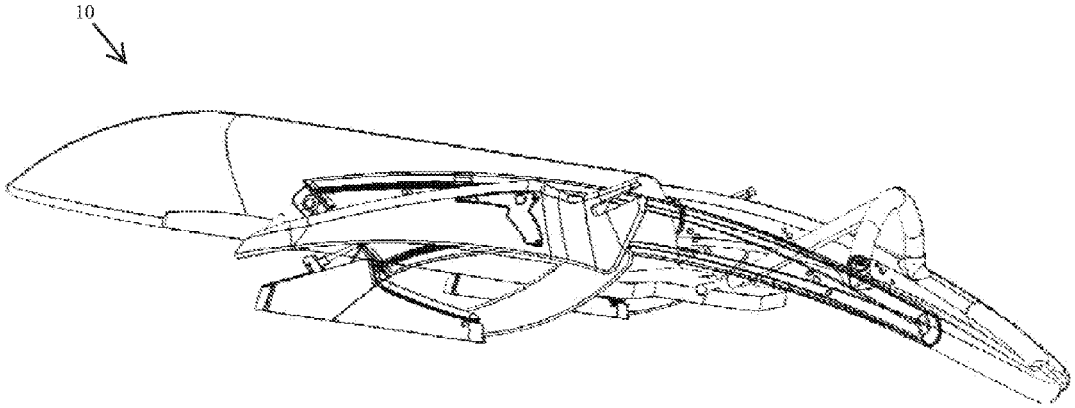
FIG. 6 shows the tower of FIGS. 1-4 in fully folded or lowered position.
Figure 7:
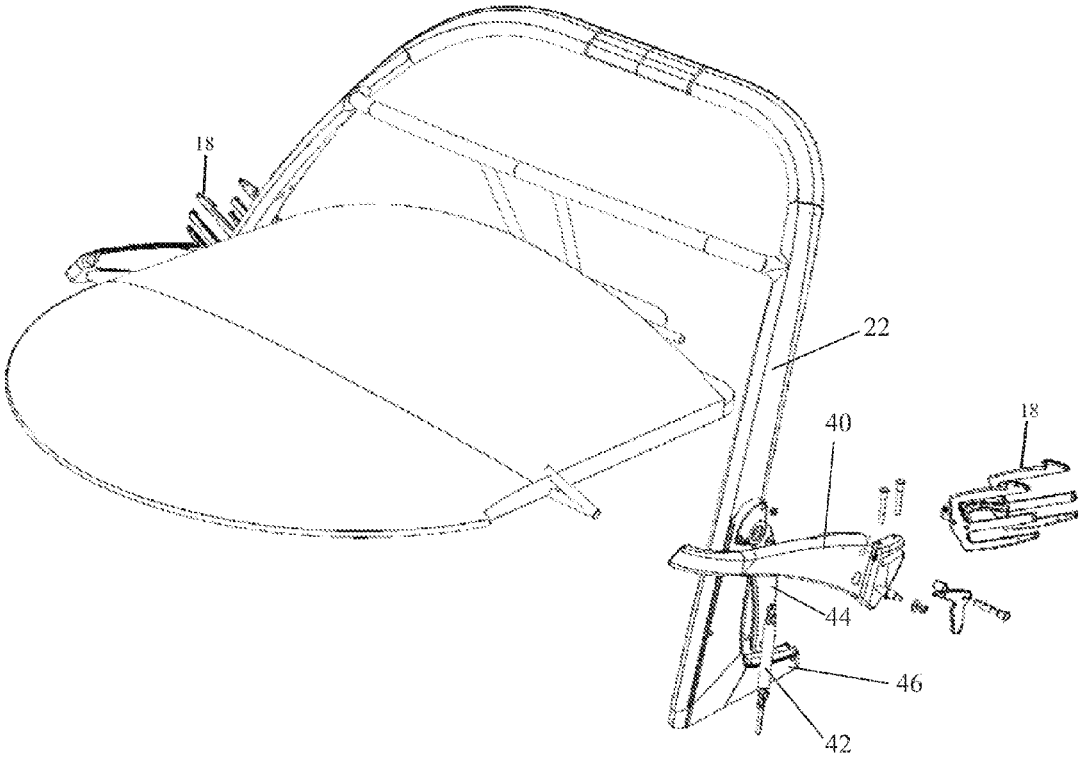
FIGS. 7 and 8 are partly exploded view of the tower of FIG. 1.
Figure 8:
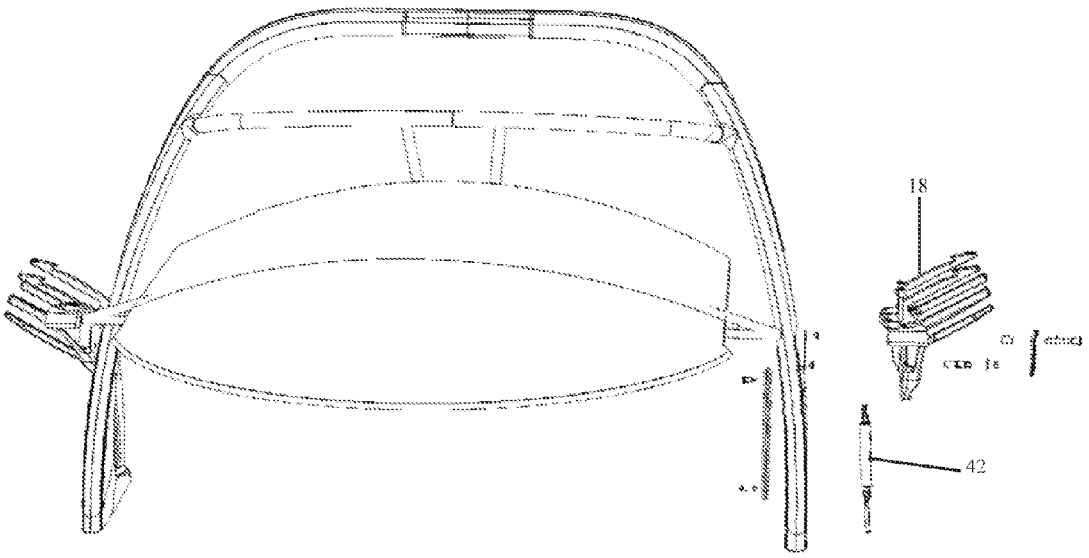
Figure 9:
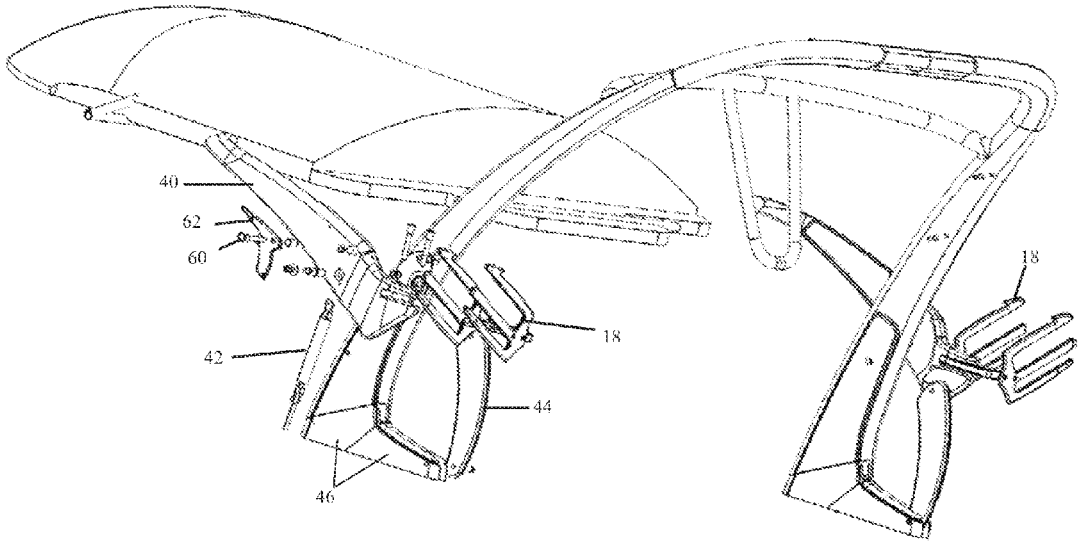
FIG. 9 is a fully exploded view of the tower of FIG. 1.
Figure 10:
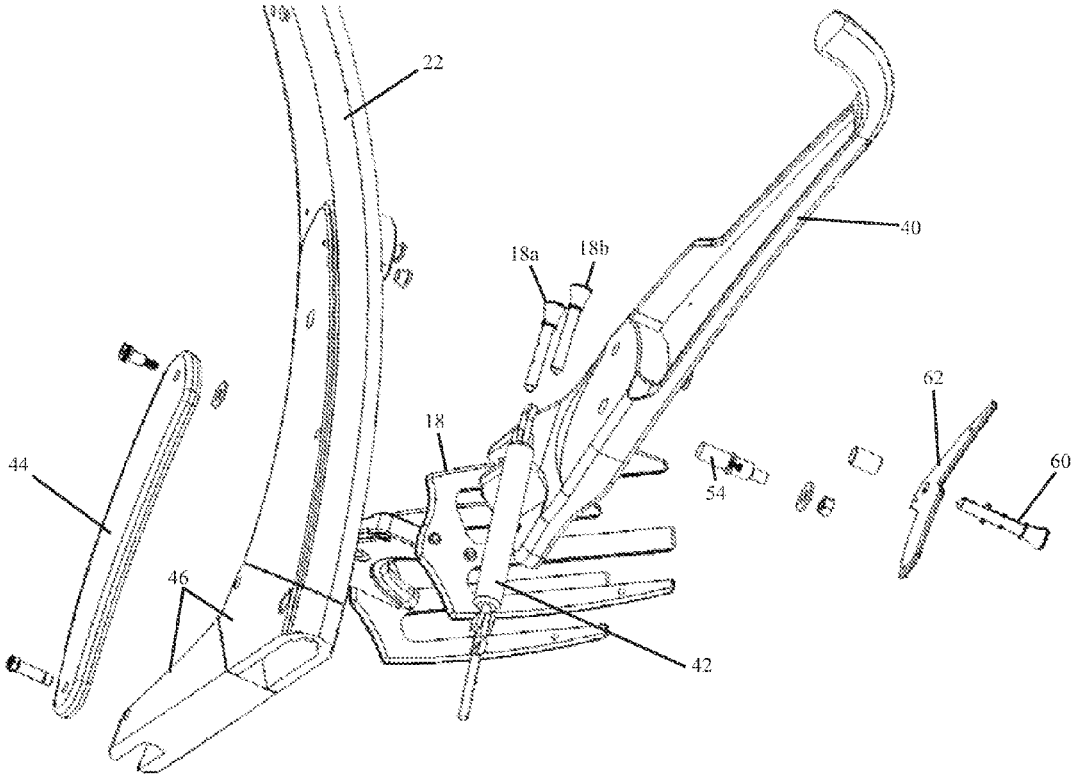
FIGS. 10-12 are exploded views from different perspectives of a foldable support system of the tower of FIG. 1.

FIGS. 1-4 show the tower 10 in a fully erected or elevated position. FIG. 5 shows the tower 10 in a half-elevated position. FIG. 6 shows the tower 10 in a fully folded or lowered position.

The tower 10 includes as structural members an arch 20 having a crosspiece 22 and a pair of legs 22 and 24. The tow point location 12 is centrally located on the crosspiece 22. The components of the arch 20 are typically made of aluminum and generally configured in the shape of an arch mountable to a boat hull so as to extend in a forward or bow direction, rising along its length.

The legs 22 and 24 each mount at their lower ends to portions of the foldable support systems 16 that are secured to the boat hull on which the tower 10 is installed. Each of the legs 22 and 24 includes a main pivot surface 26 configured for pivotally receiving a portion of the foldable support system 16.

The cover 14 may be provided as a flexible fabric material dimensioned to conform to a frame 30. The cover 14 is generally of a bimini style and may be secured to the frame 30 as by straps or snap fasteners or the like so that the cover 14 fits tightly and is located so as to not interfere with the tow point location 12. The frame 30 is pivotally mounted to the arch 20 as by an upper support 32 and a pivot arm 34 connected to the frame 30 as represented by pivot arm connection axis 36. The frame 30 is also pivotally mounted to the foldable support systems 16 as described more fully below.

Each of the foldable support systems 16 includes an upper support arm 40, a traction spring 42, a lower support arm 44, and a base member 46.

The upper support arm 40 is pivotally mounted to the main pivot surface 26 of the leg 22 by a pivot axle retaining screw 50 located through an aperture 52 in the arm 40 that receives a pivot axle 54. The pivot position of the upper support arm 40 is controlled as by a spring-loaded pivot lock pin 60 inserted through an aperture of a cover 62 and an aperture 64 of the upper support arm 40, with the terminal end of the lock pin 60 being received by one of a plurality of apertures 66 defined on the main pivot surface 26. The arm 40 pivots as seen in FIGS. 13-15 as the tower 10 travels from the fully elevated position to the fully lowered position.

Figure 11:
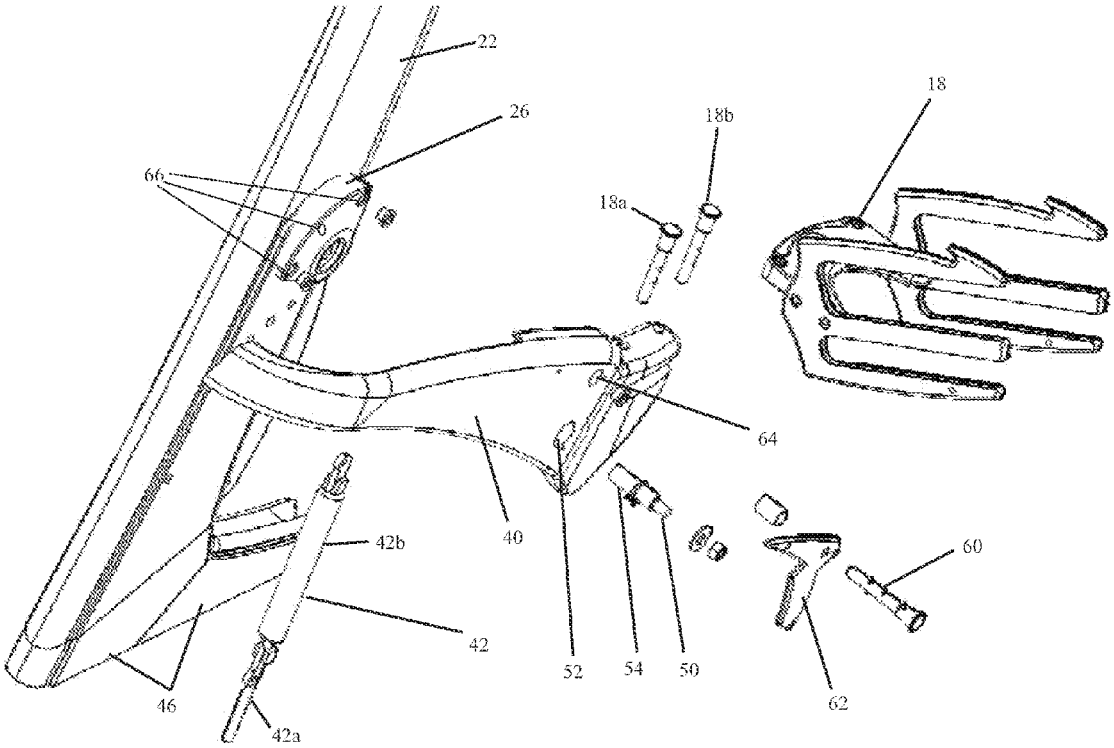
Figure 12:
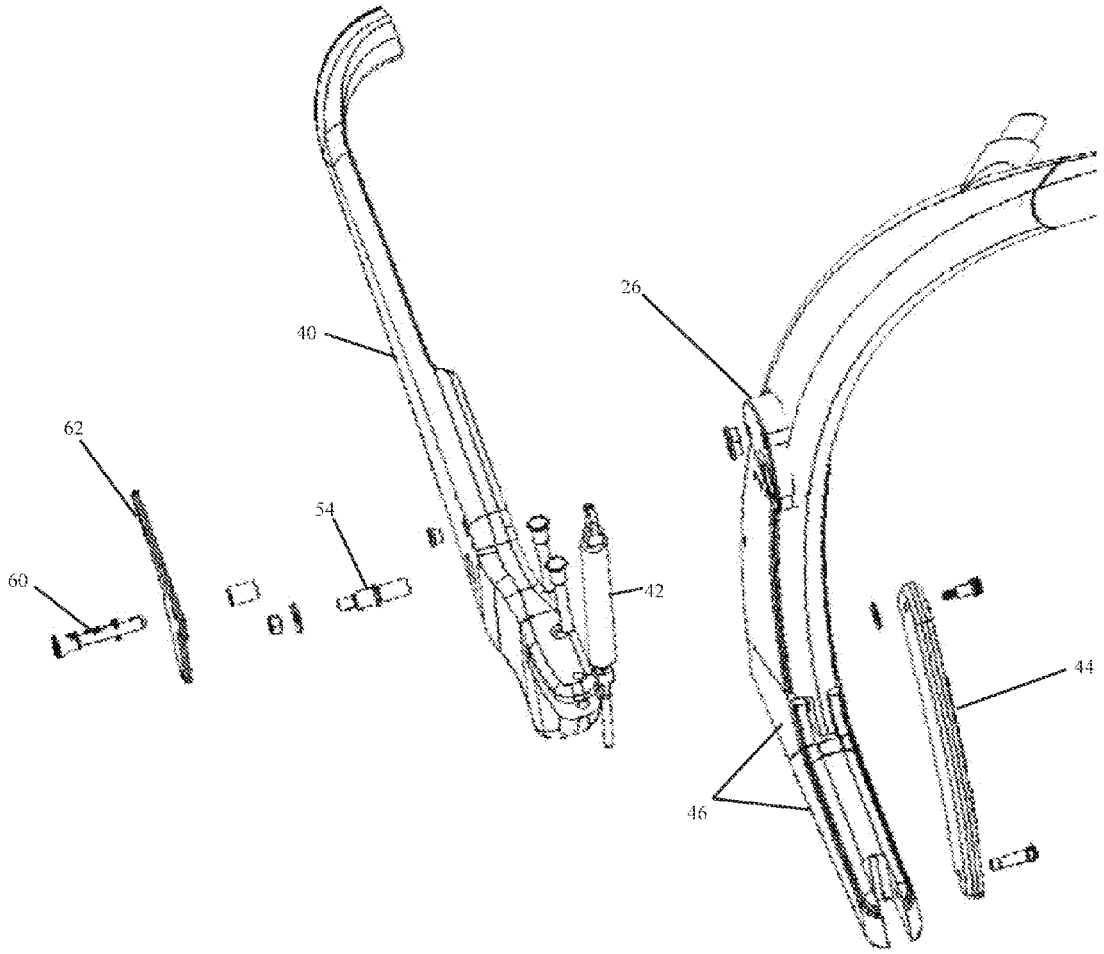

The traction spring 42 connects between the leg 22 and the base member 46. The traction spring 42 is fully retracted when the tower 10 is in the fully elevated position and is fully extended when the tower 10 is in the fully lowered position, as depicted in FIGS. 13-15. The traction spring 42 is preferably located within the interior cavity of the leg 22. The traction spring 42 is preferably a traction gas spring having a piston 42*a* that is in an unloaded state inside a cylinder 42*b* (FIG. 11). When the piston 42*a* is loaded and pulled out of the cylinder 42*b*, a force is exerted to retract the piston 42*a* back into the cylinder 42*b*. In other embodiments, the traction spring may comprise other types of springs to provide assistance to a user raising and lowering the tower 10. In certain embodiments, other biasing mechanisms, such as a motor with an electric linear actuator, could be used, A motor could offer push button convenience to lower and raise the tower.

Figure 13:
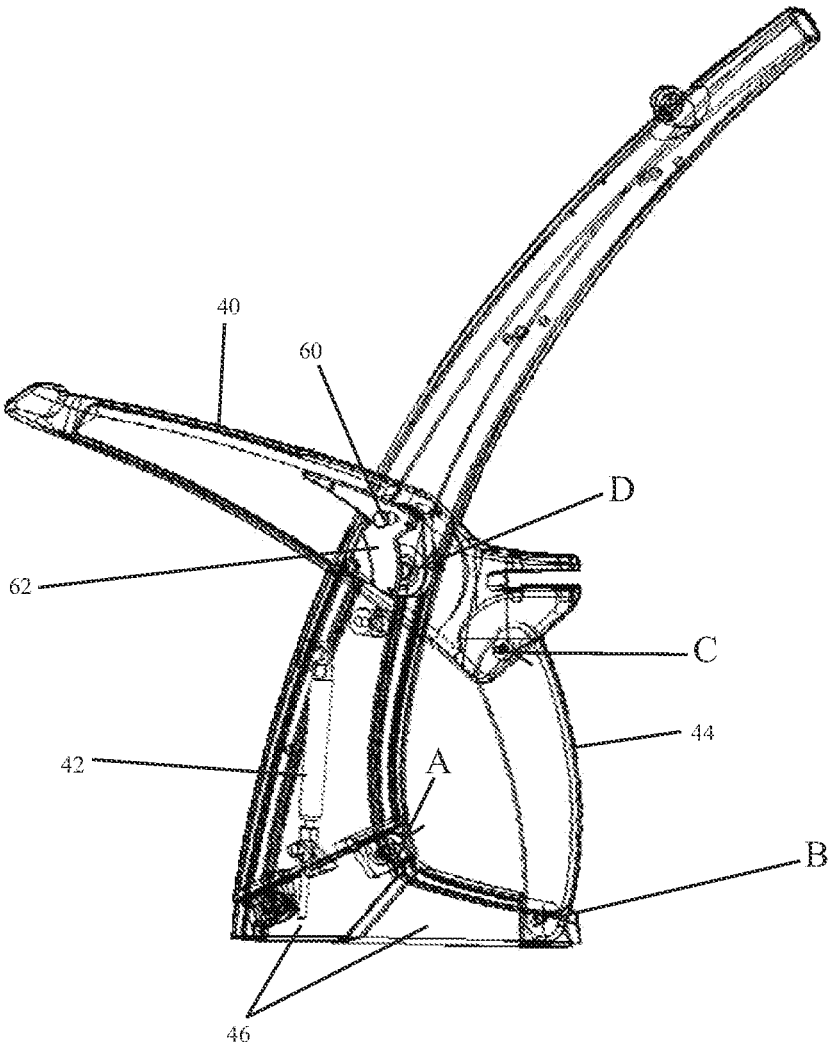
FIGS. 13-15 are transparent views showing tower components in the fully elevated, half-elevated, and fully-lowered positions.
Figure 14:
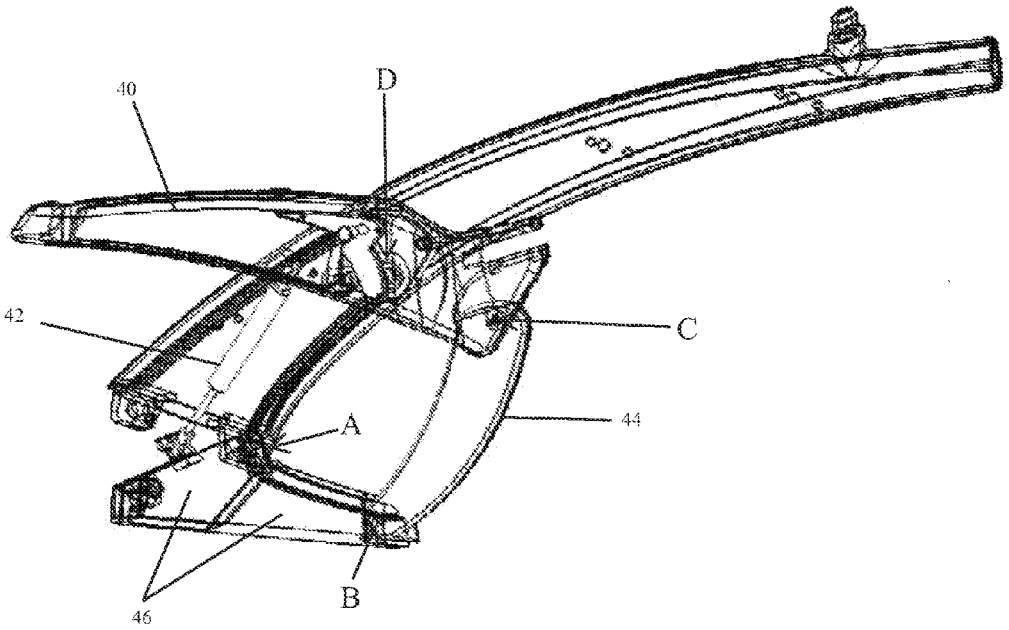
Figure 15:
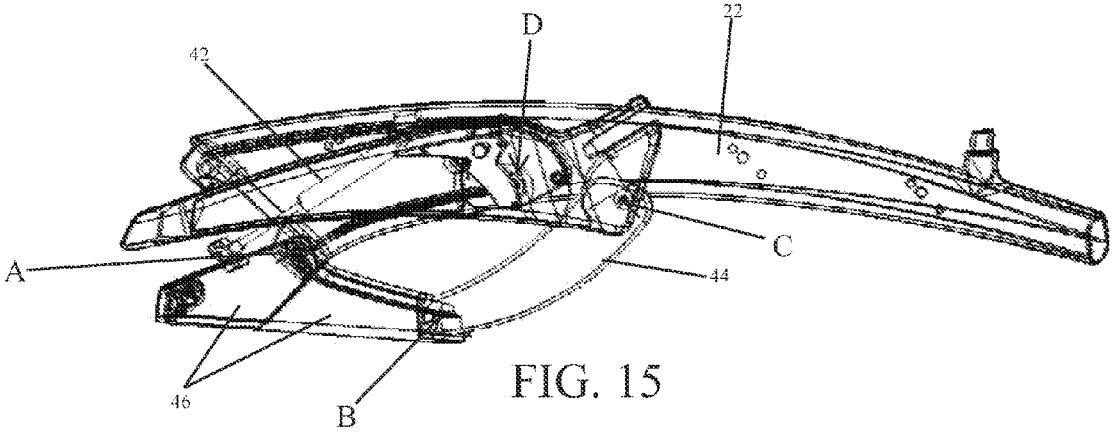

The lower support arm 44 is pivotally mounted between a rear end of the upper support arm 40 and the rear end of base member 46, The lower support arm 44 reclines as the tower 110 is lowered, as seen in FIGS. 13-15.

The base member 46 is fixedly mounted to the boat hull on which the tower 10 is located. As seen in FIGS. 13-15, the leg 22 is pivotally mounted to the base member 46.

The racks 18 are operatively associated with the foldable support system 16 so as to be able to swivel inboard and outboard when the tower 10 is fully elevated, and to be removable so that they can be removed when the tower 10 is to be located in the fully lowered position for transporting the boat. This may be accomplished by use of pivot quick release pins 18*a* and quick release swivel pins 18*b* operatively associated between the rack 18 and the foldable support system 16.

Accordingly, it will be appreciated that the tower 10 according to the disclosure advantageously provides a foldable wakeboard tower that allows for more compact folding lower to the deck. Both the cover 14 and the arch 20 can be folded to a height that is tower than the top of the windshield of the boat. This is highly desirable for small boats which are sometimes stored in a home garage with normal height roll up doors. Both the cover 14 and arch 20 may also be lowered to a half-elevated position, such as when the boat needs to pass under a bridge, while providing continued sun coverage to occupants of the boat.

The cover 14 and the arch 20 are advantageously connected to one another to enable each to be folded at the same time and in one motion by the user. For example, the frame 30 of the cover 14 is pivotally mounted to the arch 20 and the frame 30 is also pivotally mounted to the foldable support systems 16. Thus, as the tower 10 is raised or lowered, the frame 30, and hence the cover 14, pivots and moves with the tower 10, as seen in FIGS. 13-15. As shown in FIGS. 13-15, the cover remains in a substantially horizontal position as the tower is lowered from fully elevated position to the fully lowered position. This provides an aerodynamic position to the cover when the tower is towed. This also allows the cover to provide continuous sun coverage to occupants if the boat is lowered during use, such as when the boat is passing under bridges.

The tower 10 is also configured for improved stability. For example, the tower 10 includes four attachment or connection points A, B, C, and D per side of the tower 10, as shown in FIGS. 13-15. Attachment point A is a pivotal connection of the leg 22 to the base member 46. Attachment point B is a pivotal connection of the lower support arm 44 to the base member 46. The attachment point C is the pivotal connection of the upper support arm 44 to the lower support arm 44. The attachment point D is the pivotal connection of the upper support arm 40 to the leg 22.

The four attachment or connection points A-D provide a great deal of stability at every articulation position, full up, full down, half up, etc. This is advantageous because boat users often keep their boat in a location far away from water, needing to tow it to water. When the boat is trailered behind a towing vehicle, such as a truck this tower can be positioned fully folded down. This provides better aerodynamics, and better gas mileage. Furthermore, when the tower is fully folded, it is not subjected to being hit by bugs, and other road debris, keeping the tower and cover clean. Currently, towers are typically towed in the full upright position, creating great air resistance. Upright towers are bombarded with bugs. When the boat arrives for use, it needs to be cleaned.

The disclosure also enables such a tower further advantageously configured to enable the tower height to be fixed at a plurality of heights, such as fully elevated, half-elevated, and filly lowered. It will be appreciated that the tower 10 may be configured to enable additional incremental heights between fully elevated and fully lowered. Incremental heights allow for the tower to be lowered in fixed positions while the boat is being driven. Positions lower than fully elevated will allow the boat to be driven under bridges with low height overhead clearances.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed:

1. A foldable boat tower mountable to a boat, the tower comprising:

an arch foldable between an elevated position and a lowered position, the arch having a crosspiece and a leg depending from the crosspiece;

a foldable support system including a base member mounted to the boat, an upper support arm, a lower support arm connected to the upper support arm and the base member, and a biasing mechanism connected to the leg and the base member;

a first attachment point comprising a pivotal connection of the leg to the base member;

a second attachment point comprising a pivotal connection of the lower support arm to the base member;

a third attachment point comprising a pivotal connection of the upper support arm to the lower support arm; and a fourth attachment point comprising a pivotal connection of the upper support arm to the leg, wherein the tower can be folded between a plurality of positions between an elevated position relative to the boat and a lowered position relative to the boat.

2. The foldable boat tower of claim 1, further comprising a cover including a frame pivotally mounted to the arch and pivotally mounted to the foldable support system.

3. The foldable boat tower of claim 2, further comprising an elevated tow point on the arch, wherein the cover does not interfere with the tow point so that the cover may be used when pulling a wakeboarder and the cover does not interfere with a tow rope attached to the tow point.

4. The foldable boat tower of claim 1, wherein the biasing mechanism comprises a traction spring.

5. The foldable tower of claim 1, wherein the biasing mechanism comprises an electric linear actuator.

6. The foldable boat tower of claim 1, further comprising one or more racks operatively associated with the foldable support system so as to be able to swivel inboard and outboard when the tower is fully elevated, and to be removable from the tower.

7. A foldable boat tower mountable to a boat, the tower comprising:

an arch foldable between an elevated position and a lowered position, the arch having a crosspiece and a pair of legs depending from opposite ends of the crosspiece; and a foldable support system associated with each of the legs, each foldable support system including a base member mounted to the boat, an upper support arm, and a lower support arm connected to the upper support arm and the base member, with the leg pivotally connected to the base member, the lower support arm pivotally connected to the base member, the upper support arm pivotally connected to the lower support arm, and the upper support arm pivotally connected to the leg, wherein the tower can be folded between a plurality of positions between an elevated position relative to the boat and a lowered position relative to the boat.

8. The foldable boat tower of claim 7, further comprising a cover including a frame pivotally mounted to the arch and pivotally mounted to each of the foldable support systems.

9. A foldable boat tower mountable to a boat the tower comprising:

an arch foldable between an elevated position and a lowered position, the arch having a crosspiece and a pair of legs depending from opposite ends of the crosspiece;

an elevated tow point on the arch;

a cover including a frame pivotally mounted to the arch at a first frame pivot point:

a support operably associated with and pivotally mounted to the frame and movably positionable to maintain the frame in a substantially horizontal orientation, wherein the frame is pivotaily mounted to the support at a second frame pivot point that is offset from the first frame pivot point such that when the arch is folded between the elevated position and the lowered position the frame simultaneously pivots with respect to the arch about the first frame pivot point and pivots with respect to the support about the second frame pivot point such that the frame is maintained in the substantially horizontal position, wherein the cover does not interfere with the tow point so that the cover may be used when pulling a wakeboarder and the cover does not interfere with a tow rope attached to the tow point.

10. The foldable boat tower of claim 9, wherein an upper end of the support is pivotally connected to the frame and a lower end of the support is pivotally connected to a base member mountable to the boat.

11. The foldable boat tower of claim 10, wherein the support comprises an upper arm pivotally connected to the frame and a lower support arm pivotally connected to the upper support arm and pivotally connected to the base member.

12. The foldable boat tower of claim 10, wherein the support is pivotally connected to the base member at a first base pivot point and one of the legs is pivotally connected to the base member at a second base pivot point offset from the first base pivot point.

13. The foldable boat tower of claim 11, wherein the upper support arm is pivotally connected to one of the legs.

14. The foldable boat tower of claim 9, wherein the cover is located below the crosspiece and between the pair of legs.

* * * * *